US005873496A

United States Patent [19]

Montaner et al.

[11] Patent Number: 5,873,496

[45] Date of Patent: Feb. 23, 1999

[54] ASSEMBLY FOR NON-REMOVABLY FIXING A CLOSURE CAP TO A DISPENSER BODY

[75] Inventors: Pedro Parés Montaner; Lluis Costa Quintas, both of Barcelona, Spain

[73] Assignee: Monturas, S.A., Barcelona, Spain

[21] Appl. No.: 868,946

[22] Filed: Jun. 4, 1997

[30] Foreign Application Priority Data

Dec. 18, 1996 [ES] Spain ..... 9602671

[51] Int. Cl.[6] ..... B67D 5/40

[52] U.S. Cl. ..... 222/153.09; 222/383.1; 222/481.5; 239/333

[58] Field of Search ..... 222/153.09, 380, 222/383.1, 464.1, 481.5; 239/333

[56] References Cited

U.S. PATENT DOCUMENTS 4,168,788 9/1979 Quinn ..... 222/383.1
4,454,965 6/1984 Kirk, Jr. ..... 222/153.09
5,593,093 1/1997 Foster et al. ..... 222/383.1
5,738,251 4/1998 Schuckmann ..... 222/481.5
5,779,108 7/1998 Barriac et al. ..... 222/383.1

FOREIGN PATENT DOCUMENTS 468902 1/1992 European Pat. Off. ..... 222/153.09

*Primary Examiner*—Joseph A. Kaufman
*Attorney, Agent, or Firm*—Watson Cole Grindle Watson, P.L.L.C.

[57] ABSTRACT

A dispenser has its closure cap non-removably affixed to a cylindrical attaching portion of its dispenser body by a snap-fit engagement between a folded lower end section of the attaching portion and the closure or a plug located within the closure and in engagement with the attaching portion. The folded lower end section presents an end edge facing outwardly of the closure which engages an inwardly facing end wall of the closure or of the plug.

10 Claims, 2 Drawing Sheets

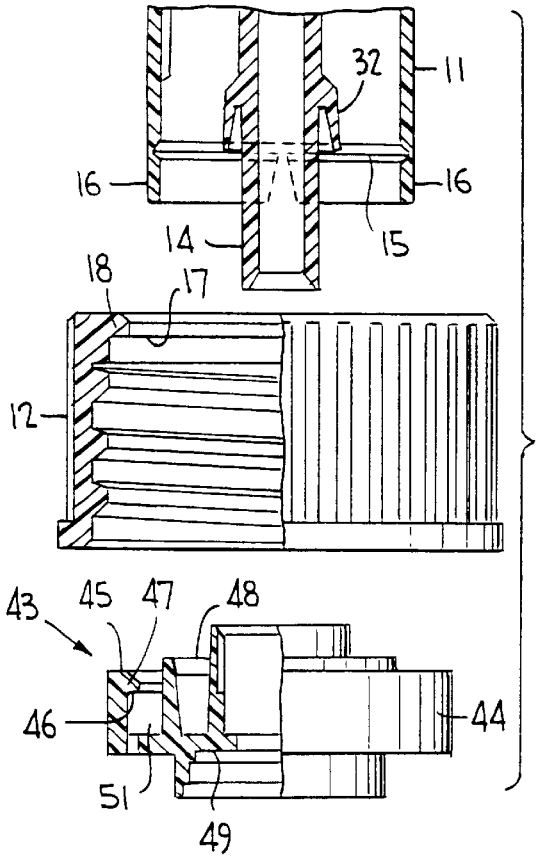
FIG. 7
FIG. 9
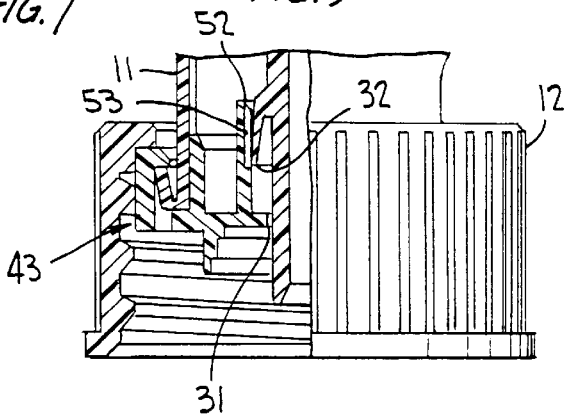
FIG. 8
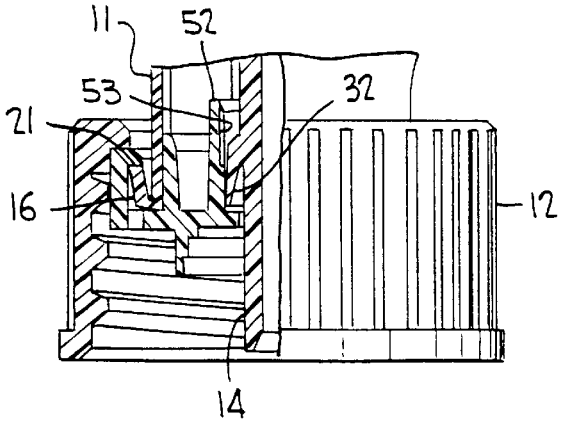
FIG. 10
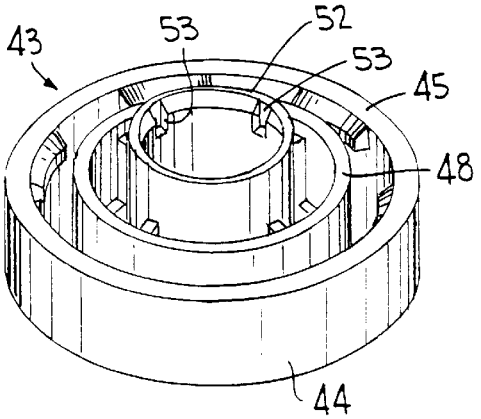

ASSEMBLY FOR NON-REMOVABLY FIXING A CLOSURE CAP TO A DISPENSER BODY

BACKGROUND OF THE INVENTION

This invention relates generally to a dispenser to which a closure cap is non-removably fixed. A folded lower end section of a cylindrical attaching portion of the dispenser defines an end edge facing outwardly of the closure to facilitate the fixing of the closure cap by a snap-fit engagement either with the closure cap or with a plug located within and in engagement with the closure.

Manually operated pump dispensers are mounted on containers of liquid to be dispensed by a container closure either having internal threads engaging the threads on the bottle neck, or a ferrule engaging a bead on the container neck. The closure cap is mounted on the dispenser body such that the dispenser may be mounted to the liquid filled container by simply threading down the closure cap on the bottle neck or by swaging the cap in place.

The closure cap is mounted to a generally cylindrical attaching portion of the dispenser body as, for example, with the use of a hollow sleeve having an external flange engaging an internal retention lip at one end of the closure. The sleeve extends into the cylindrical attaching portion and is frictionally held in place. However, such a mounting assembly may prove unreliable as the frictional engagement can fail during extended periods of use.

Otherwise, the cylindrical attaching portion may have an external molded flange such that the internal retention lip on the closure cap makes a snap fit engagement with the flange for retaining the closure cap in place. However, this approach can be capital intensive in that the cylindrical attaching portion of the dispenser body must be specially molded.

SUMMARY OF THE INVENTION

It is therefore an object of the present invention to provide a dispenser having a closure cap non-removably affixed to the cylindrical attaching portion thereof, in a simple and economical yet highly effective manner without the need for special molding.

In accordance with the invention a lower end section of the cylindrical attaching portion of the pump body is folded, inwardly or outwardly, to define an end edge facing outwardly of the closure. The folded lower end section is snap-fitted to either the closure or to a plug which engages the closure. When snap-fitted in place, the end edge engages a retention lip at one end of the closure, or engages an edge wall on the plug which faces inwardly of the closure.

When utilized with a dispenser having a hollow piston stem reciprocable along the central axis of the cylindrical attaching portion of the pump body, the plug may be provided with container vent means cooperating with the piston stem for controlling the container vent function during piston reciprocation. And, a transverse wall of the plug having a central opening through which the piston stem extends may have means at the central opening defining a container vent path.

Other objects, advantages and novel features of the invention will become more apparent from the following detailed description of the invention when taken in conjunction with the accompanying drawings.

BRIEF DESCRIPTION OF THE DRAWINGS

FIG. 7 is an expanded view of a further embodiment according to the invention, in vertical section, of the attaching portion of the dispenser, the closure and a plug, the reciprocable piston stem of the dispenser being shown relative to the attaching portion;

FIG. 8 is a view similar to FIG. 7 showing the parts assembled together, and the vertically reciprocating piston stem at rest;

FIG. 9 is a view similar to FIG. 8 with the vertically reciprocable piston stem shown during pumping; and FIG. 10 is a perspective view of the plug according to the FIGS. 7 to 9 embodiment.

DETAILED DESCRIPTION OF THE INVENTION

Figure 1:
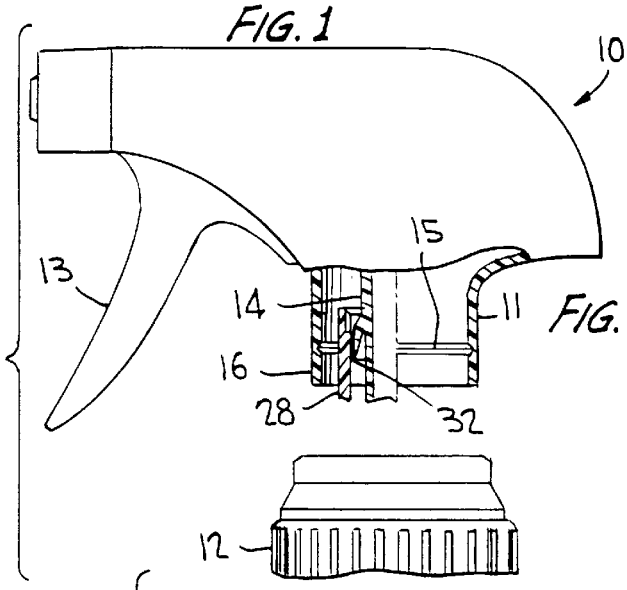
FIG. 1 is a side elevational view of one embodiment according to the invention, partly broken away, of a dispenser and a container closure, shown in expanded view.

Turning now to the drawings wherein like reference characters refer to like and corresponding parts throughout the several views, a dispenser 10 is shown in FIG. 1 as having a generally cylindrical attaching portion 11 to which a closure cap 12 is non-removably fixed according to one embodiment of the invention. The dispenser may be of the type having a vertically reciprocating piston (not shown) actuated by a trigger lever 13 upon manual actuation. The piston has a hollow stem 14 coaxial with attaching portion 11, the lower end of the stem extending into the closure cap as shown.

Attaching portion 11 has an inner annular groove presenting a fold line 15 which delimits a lower end section 16. As more clearly shown in FIG. 2, the closure cap has an internal retention lip 17 at one end presenting an inwardly facing end wall 18.

Figure 2:
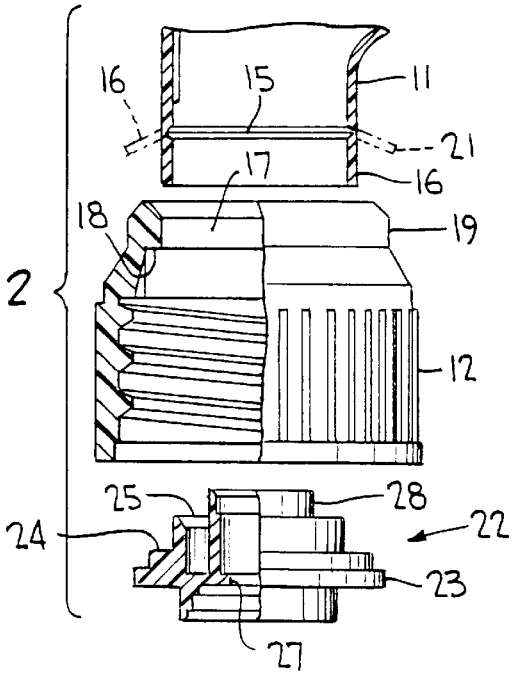
FIG. 2 is an expanded view, partially in vertical section, of the attaching portion of the dispenser, the closure and a plug, in expanded view, prior to assembly, according to the FIG. 1 embodiment.

The dispenser including its attaching portion may be of a sufficiently pliable molded plastic construction permitting lower end section 16 to be outwardly folded from its FIG. 1 to its FIG. 2 position about fold line 15 during the assembly operation as with the use of a suitable tool. Movement of the dispenser in the direction toward the closure cap completes the fold of the end section as the same bears against the crown portion 19 of cap, or is already fully folded by means of a tool, such that the pliable attaching portion is forced through the central opening of the cap into snap-fitting engagement with retention lip 17.

Figure 3:
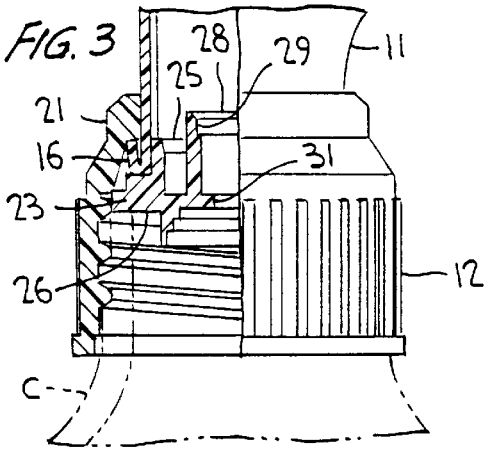
FIG. 3 is a view similar to FIG. 2 showing the closure non-removably fixed to the dispenser body.

The outwardly folded lower end section presents an end edge 21 which faces outwardly of the closure and which, in the assembled condition of FIG. 3, engages end wall 18 of the retention lip. The closure cap is thereupon non-removably fixed to the dispenser body to effect mounting of the dispenser to a suitable container C (FIG. 3) as the complementary threads of the closure cap and bottle neck interengage. Of course, the closure cap can otherwise be in the form of a ferrule which is swaged to the container neck in a manner known in this art.

The snap-fit interengagement of the dispenser attaching portion with the closure cap may be enhanced by the provision of a plug 22 which has several functions as will be described. The plug has a transverse circular wall 23 in tight fitting engagement with the interior of the closure, such that its upwardly facing annular surface 24 bears against the confronting edge of the folded lower end section, as shown in FIG. 3.

The plug likewise has an outer sleeve 25 which bears in tight fitting engagement against the inner surface of attaching portion 11. And, an underside annular surface 26 of wall 23 bears directly against the upper edge of the container neck, so as to avoid the need for a separate gasket, depending on the stiffness of the plug.

Transverse wall 23 of the plug has a central opening 27 through which piston stem 14 extends, and has an upstanding inner sleeve 28 with one or more vertical grooves 29 on its inner surface forming vent grooves. Otherwise, vent ribs could be provided as the full equivalent of vent grooves.

The circular edge at central opening 27 can be either oversized relative to the piston stem or, more preferably, is notched as at 31 so as to establish a vent path from outside to the interior of the container during pumping. This vent path is sealed closed by a vent seal 32 (FIG. 1) which, in the at rest position of the pump, seals against the confronting inner surface of sleeve 28. At or near the end of the piston compression stroke, vent seal 32 engages vent grooves 29 for venting the container to atmosphere to prevent hydraulic lock and container collapse.

Figure 4:
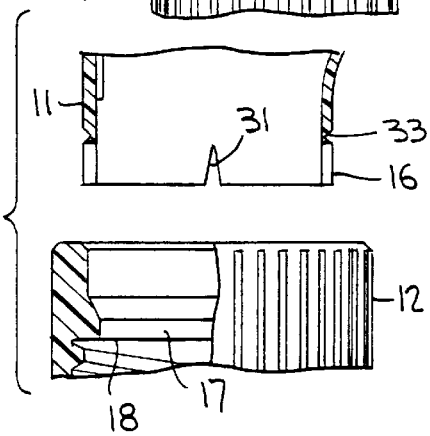
FIG. 4 is an expanded view of a dissembled attaching portion and closure according to another embodiment of the invention.
Figure 5:
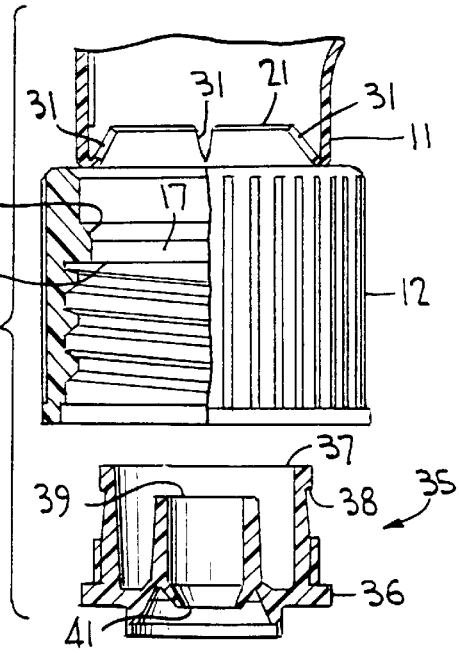
FIG. 5 is a view similar to FIG. 4 showing a plug as part of the assembly with the lower end section of the attaching portion folded inwardly, according to the FIG. 4 embodiment.
Figure 6:
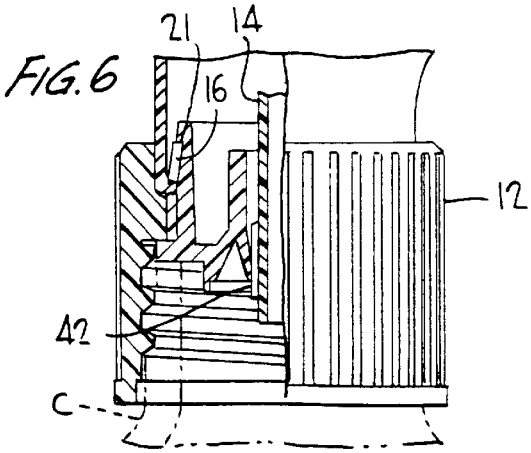
FIG. 6 is a view similar to FIG. 5 of parts fully assembled together.

In accordance with another embodiment of the invention, shown in FIGS. 4, 5, and 6, attaching portion 11 has an external annular groove presenting a fold line 33 which delimits lower end section 16. The end section of this embodiment is notched as at 34 to facilitate an inner folding of the end section as shown in FIG. 5 as with the use of a suitable tool.

During assembly, the closure cap and attaching portion 11 are moved toward one another along the central axis thereof such that portion 11 seats against conical surface 34, as shown in FIG. 6. A plug 35 is inserted into the closure cap from below, the plug having a transverse wall 36 engaging end wall 18 of retention lip 17. An outer sleeve 37 of the plug has formed on its outer surface an annular undercut presenting an edge wall 38.

In the assembled condition of FIG. 6, lower end section 16 is snap-fitted to plug 35 as end edge 21 engages edge wall 38. The plug therefore effects engagement between the dispenser and the closure, and likewise functions as a gasket overlying the upper edge of the container neck. Also, the plug has an inner sleeve 39 with a vent seal 41 in sliding sealing engagement with piston stem 14 in the FIG. 1 at rest position. During pumping, the sealing action with the piston stem is broken as the vent seal engages vent ribs 42 (FIG. 6) or vent grooves (not shown) on piston stem 14. The container is therefore vented to atmosphere during pumping in a simple and effective manner.

In accordance with a further embodiment of the invention, FIGS. 7 to 10, lower end section 16 is folded outwardly as in the FIGS. 1 to 3 embodiment, except that the folded lower end section is, in the assembled condition of FIG. 8, snap-fitted to plug 43. Annular wall 44 of the plug snugly embraces the interior of the closure cap, and top surface 45 thereof engages retention bead 18 of the closure cap.

An outer upstanding skirt 48, integral with transverse wall 49, snugly embraces the inner surface of attaching portion 11, and forms an open annular groove 51 for the reception of outwardly folded end section 16, as shown.

An inner skirt 52 on transverse wall 49 has one or more vertical vent grooves 53 formed on its inner surface, as more clearly shown in FIG. 10. And, notches 31 are formed at the edge of central opening 27 of transverse wall 49, similarly as in FIG. 3. Thus, during pumping, as the piston stem is raised at or near the end of the pressure stroke, the vent seal engages vertical grooves 53 to open the vent path through which atmospheric air enters the container. And, as in the other embodiments, plug 43 overlies the open edge of the bottle neck and can function as a gasket without the need for a separate gasket element.

From the foregoing it can be seen that a simple and economical yet highly effective assembly for non-removably fixing a closure cap to a dispenser body is provided by simply folding the lower end section of the annular attaching portion of the dispensing pump body, outwardly or inwardly. The folded lower end section snap-fits to either the closure or to a plug which has a multiplicity of functions. The attaching portion of the dispenser therefore need not be specially molded as it is essentially cylindrical thereby reducing costs and complexity of assembly. The plugs used in the present assemblies are multi-functional in facilitating snap-fit engagement, functioning as a container vent, and as a gasket seal.

Obviously, many other modifications and variations could be effected by one skilled in the art without departing from the scope and the spirit of this invention, as defined by the appended claims. For example, a container closure may be non-removably snap-fitted to a dispenser having a horizontally or angularly disposed reciprocable piston, without departing from the invention. And, the closure, after being fixed to the pump body, can be designed for relative rotation within the teachings of the invention.

What is claimed is:

1. A dispenser comprising, a body having a cylindrical attaching portion, a closure cap non-removably affixed to said attaching portion and having means engageable with a container neck for mounting the dispenser thereto, said cap having an internal retention lip at one end, characterized in that a lower end section of said attaching portion is folded outwardly to define an end edge facing outwardly of said closure and engaging an underside of said retention lip, a plug located within said closure in engagement with said attaching portion and with said closure, said folded lower end section being snap-fitted to one of said plug and said closure for positively fixing said cap to said body.

2. A dispenser comprising, a body having a cylindrical attaching portion, a closure cap non-removably affixed to said attaching portion and having means engageable with a container neck for mounting the dispenser thereto, said cap having an internal retention lip at one end, characterized in that a lower end section of said attaching portion is folded to define an end edge facing outwardly of said closure, said attaching portion extending through a central opening of said closure, a plug located within said closure and having an annular sleeve extending into said attaching portion and engaging an inner surface thereof, said folded lower end section being snap-fitted to one of said plug and said closure for positively fixing said cap to said body.

3. A dispenser comprising, a body having a cylindrical attaching portion, a closure cap non-removably affixed to said attaching portion and having means engageable with a container neck for mounting the dispenser thereto, said cap having an internal retention lip at one end, characterized in that a lower end section of said attaching portion is folded to define an end edge facing outwardly of said closure, said attaching portion extending through a central opening of said closure, said end edge engaging in edge wall on said plug facing inwardly of said closure, a plug located within said closure in engagement with said attaching portion and with said closure, said folded lower end section being snap-fitted to one of said plug and said closure for positively fixing said cap to said body.

4. The dispenser according to claim 3, characterized in that said lower end section is folded inwardly, said plug having an annular sleeve in engagement with said lower end section of said attaching portion, said edge wall being formed on an outer surface of said sleeve.

5. The dispenser according to claim 3, characterized in that said lower end section is folded outwardly, said plug engaging said retention lip.

6. The dispenser according to claim 3, characterized in that said plug has an annular sleeve in engagement with an inner surface of said attaching portion, said sleeve being spaced inwardly of said annular edge to therewith define an annular groove for the reception of said lower end section.

7. A dispenser comprising, a body having a cylindrical attaching portion, a closure cap non-removably affixed to said attaching portion and having means engageable with a container neck for mounting the dispenser thereto, said cap having an internal retention lip at one end, characterized in that a lower end section of said attaching portion is folded to define an end edge facing outwardly of said closure, a plug having a transverse wall and a sleeve on said wall extending into engagement with said attaching portion and with said closure, said folded lower end section being snap-fitted to one of said plug and said closure for positively fixing said cap to said body, and said sleeve having container vent means thereon.

8. A dispenser comprising, a body having a cylindrical attaching portion, a pump piston having a hollow stem mounted for reciprocation along a central axis of said portion, a closure cap non-removably affixed to said attaching portion and having means engageable with a container neck for mounting the dispenser thereto, said cap having an internal retention lip at one end, characterized in that a lower end section of said attaching portion is folded to define an end edge facing outwardly of said closure, a plug located within said closure in engagement with said attaching portion and with said closure, said folded lower end section being snap-fitted to one of said plug and said closure for positively fixing said cap to said body, and a vent seal on said stem engageable with vent means on said plug for venting the container during piston reciprocation.

9. A dispenser comprising, a body having a cylindrical attaching portion, a pump piston having a hollow stem mounted for reciprocation along a central axis of said portion, a closure cap non-removably affixed to said attaching portion and having means engageable with a container neck for mounting the dispenser thereto, said cap having an internal retention lip at one end, characterized in that a lower end section of said attaching portion is folded to define an end edge facing outwardly of said closure, a plug located within said closure in engagement with said attaching portion and with said closure, said folded lower end section being snap-fitted to one of said plug and said closure for positively fixing said cap to said body, and a vent seal on said plug engageable with vent means on said stem for venting the container during piston reciprocation.

10. A dispenser comprising, a body having a cylindrical attaching portion, a closure cap non-removably affixed to said attaching portion and having means engageable with a container neck for mounting the dispenser thereto, said cap having an internal retention lip at one end, characterized in that a lower end section of said attaching portion is folded to define an end edge facing outwardly of said closure, a plug having a transverse wall with a central opening through which a hollow piston stem extends during pumping, said plug being located within said closure in engagement with said attaching portion and with said closure, said folded lower end section being snap-fitted to one of said plug and said closure for positively fixing said cap to said body, and said transverse wall having means to said opening defining a vent path into the container.

* * * * *